US008373735B2

(12) United States Patent
Arai et al.

(10) Patent No.: US 8,373,735 B2
(45) Date of Patent: Feb. 12, 2013

(54) LINE HEAD, IMAGE FORMING APPARATUS, IMAGE FORMING METHOD

(75) Inventors: Yoshio Arai, Shiojiri (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 573 days.

(21) Appl. No.: 12/621,345

(22) Filed: Nov. 18, 2009

(65) Prior Publication Data

US 2010/0135683 A1 Jun. 3, 2010

(30) Foreign Application Priority Data

Nov. 28, 2008 (JP) ..... 2008-304982

(51) Int. Cl.
*B41J 2/435* (2006.01)
*B41J 2/447* (2006.01)

(52) U.S. Cl. ..... 347/237

(58) Field of Classification Search ..... 347/237
See application file for complete search history.

(56) References Cited

U.S. PATENT DOCUMENTS

| | | | | |
|---|---|---|---|---|
| 4,427,275 | A | 1/1984 | Stalzer | 354/4 |
| 5,272,490 | A * | 12/1993 | Murano et al. | 347/237 |
| 7,123,278 | B2 | 10/2006 | Kudou | |
| 7,137,701 | B2 | 11/2006 | Katagiri et al. | 351/159 |
| 8,194,106 | B2 | 6/2012 | Nomura et al. | |
| 2005/0168685 | A1 | 8/2005 | Katagiri et al. | 351/159 |
| 2007/0210997 | A1 * | 9/2007 | Kasai | 345/82 |
| 2008/0030566 | A1 | 2/2008 | Nomura et al. | |

FOREIGN PATENT DOCUMENTS

| | | |
|---|---|---|
| JP | 59-038079 | 3/1984 |
| JP | 10244703 A | 9/1998 |
| JP | 2004284077 A | 10/2004 |
| JP | 2005-003817 | 1/2005 |
| JP | 2006-133420 | 5/2006 |
| JP | 2008036937 A | 2/2008 |
| JP | 2008036938 A | 2/2008 |

* cited by examiner

*Primary Examiner* — Omar Rojas
(74) *Attorney, Agent, or Firm* — DLA Piper LLP (US)

(57) ABSTRACT

Provided is a line head including: a light emitting device array in which N (N is an integer of 2 or more) light emitting device groups including a plurality of light emitting devices is arranged; an output unit which sequentially outputs driving signals for driving the light emitting devices of the light emitting device groups to the light emitting device groups; and a delay unit which delays input timings when the driving signals output from the output unit are input to the light emitting devices, wherein the delay unit delays the input timings of the 1 to (N−1)th driving signals output from the output unit to the input timings of the Nth driving signals output from the output unit, and allows the light emitting devices of the different light emitting device groups simultaneously to emit light.

5 Claims, 8 Drawing Sheets

LINE HEAD, IMAGE FORMING APPARATUS, IMAGE FORMING METHOD

BACKGROUND

1. Technical Field

The present invention relates to a line head, an image forming apparatus and an image forming method.

2. Related Art

In an image forming apparatus using an electrophotographic method, such as a copier or a printer, an exposure unit for exposing the outer surface of a rotating photosensitive body and forming an electrostatic latent image is included. As for such an exposure unit, a line head having a structure in which a plurality of light emitting devices is arranged in a rotation axis direction of the photosensitive body is known (for example, see JP-A-59-38079).

For example, in the line head disclosed in JP-A-59-38079, the plurality of Light Emitting Diodes (LEDs) is arranged in a row and the plurality of LEDs is modularized by a predetermined number. In addition, in such a line head, the plurality of LEDs sequentially is lit up for every module.

In such a line head, since the plurality of LEDs sequentially is lit up for every module, the switching timing of lighting each module should be set in consideration of the rotation velocity (circumferential velocity) of the photosensitive body. A slight error occurs in such switching timing and this error has an adverse influence on the quality of a latent image which finally is obtained. In particular, the influence of such an error on the quality of the latent image which finally is obtained is increased if a plurality of rows of the LEDs arranged in a main scanning direction is arranged in a sub scanning direction.

It is preferable that the number of signal lines for controlling lighting of the LEDs is as small as possible. Accordingly, it is possible to prevent or suppress noise from being mixed from such lines and realize a high-accuracy exposure process.

SUMMARY

An advantage of some aspects of the invention is that it provides a line head capable of realizing a high-accuracy exposure process and provides an image forming apparatus and an image forming method capable of obtaining a high-quality image.

The advantage is accomplished by the following invention.

According to an aspect of the invention, there is provided a line head including: a light emitting device array in which N (N is an integer of 2 or more) light emitting device groups including a plurality of light emitting devices is arranged; an output unit sequentially which outputs driving signals for driving the light emitting devices of the light emitting device groups to the light emitting device groups; and a delay unit which delays input timings when the driving signals output from the output unit are input to the light emitting devices, wherein the delay unit delays the input timings of the 1 to (N−1)th driving signals output from the output unit to the input timings of the Nth driving signals output from the output unit, and allows the light emitting devices of the different light emitting device groups simultaneously to emit light.

In the line head of the invention, the delay unit may include a holding portion, and sequentially hold the 1 to Nth driving signals output from the output unit in the holding portion and simultaneously then release the holding of the 1 to Nth driving signals held in the holding portion.

In the line head of the invention, the holding portion may have latch circuits provided in correspondence with the light emitting device groups, and the delay unit may have a latch switch simultaneously for switching ON/OFF of the latch circuits.

According to another aspect of the invention, there is provided an image forming apparatus including: a latent image carrier on which a latent image is formed; and a line head which exposes the latent image carrier so as to form the latent image, wherein the line head includes: a light emitting device array in which N (N is an integer of 2 or more) light emitting device groups including a plurality of light emitting devices is arranged; an output unit sequentially which outputs driving signals for driving the light emitting devices of the light emitting device groups to the light emitting device groups; and a delay unit which delays input timings when the driving signals output from the output unit are input to the light emitting devices, wherein the delay unit delays the input timings of the 1 to (N−1)th driving signals output from the output unit to the input timings of the Nth driving signals output from the output unit, and allows the light emitting devices of the different light emitting device groups simultaneously to emit light.

According to another aspect of the invention, there is provided an image forming method including: sequentially outputting driving signals for driving light emitting devices of N (N is an integer of 2 or more) light emitting device groups to the light emitting device groups; and delaying the input timings of the 1 to (N−1)th output driving signals to the input timings of the Nth output driving signals, and allowing the light emitting devices of the different light emitting device groups simultaneously to emit light so as to form a latent image on a latent image carrier.

In the image forming method of the invention, image optical systems may be provided in correspondence with the light emitting device groups, for imaging light from the light emitting devices, the light emitting device groups may be arranged in a first direction and may be arranged in a second direction perpendicular to or substantially perpendicular to the first direction, and when the light emitting devices of the light emitting device groups simultaneously emit light, a gap between spot groups formed by imaging the light from the light emitting device groups by the imaging optical systems in the second direction may be an integral multiple of a gap between pixels of the latent image in the second direction.

In the image forming method of the invention, when the light emitting devices of the light emitting device groups simultaneously emit light, a gap between spots formed by imaging the light from the light emitting devices by the imaging optical systems in the second direction may be an integral multiple of a gap between pixels of the latent image in the second direction.

In the image forming method of the invention, the imaging optical systems may be arranged in the first direction and may be arranged in the second direction, and a gap between the imaging optical systems in the second direction may be an integral multiple of the gap between the pixels of the latent image in the second direction.

According to the line head according to the present invention having the above-described configuration, since the light emitting devices of the different light emitting device groups simultaneously can emit light (can be driven), it is possible to prevent an error from occurring in the switching of light emission of the plurality of light emitting devices belonging to the light emitting device groups and, as a result, realize a high-accuracy exposure process. In particular, in such a line head, since the plurality of light emitting devices belonging to the plurality of the light emitting device groups emit light (light up) using the driving signals sequentially output from one output unit, it is possible to reduce the number of wires of the signals for controlling the lighting of the light emitting devices. As a result, it is possible to prevent or suppress noise from being mixed from the wires and realize a high-accuracy exposure process.

According to the image forming apparatus and the image forming method of the invention, it is possible to obtain a high-quality image by realizing the high-accuracy exposure process.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a line head, an image forming apparatus and an image forming method according to an embodiment of the invention will be described in detail with reference to the accompanying drawings.

Figure 1:
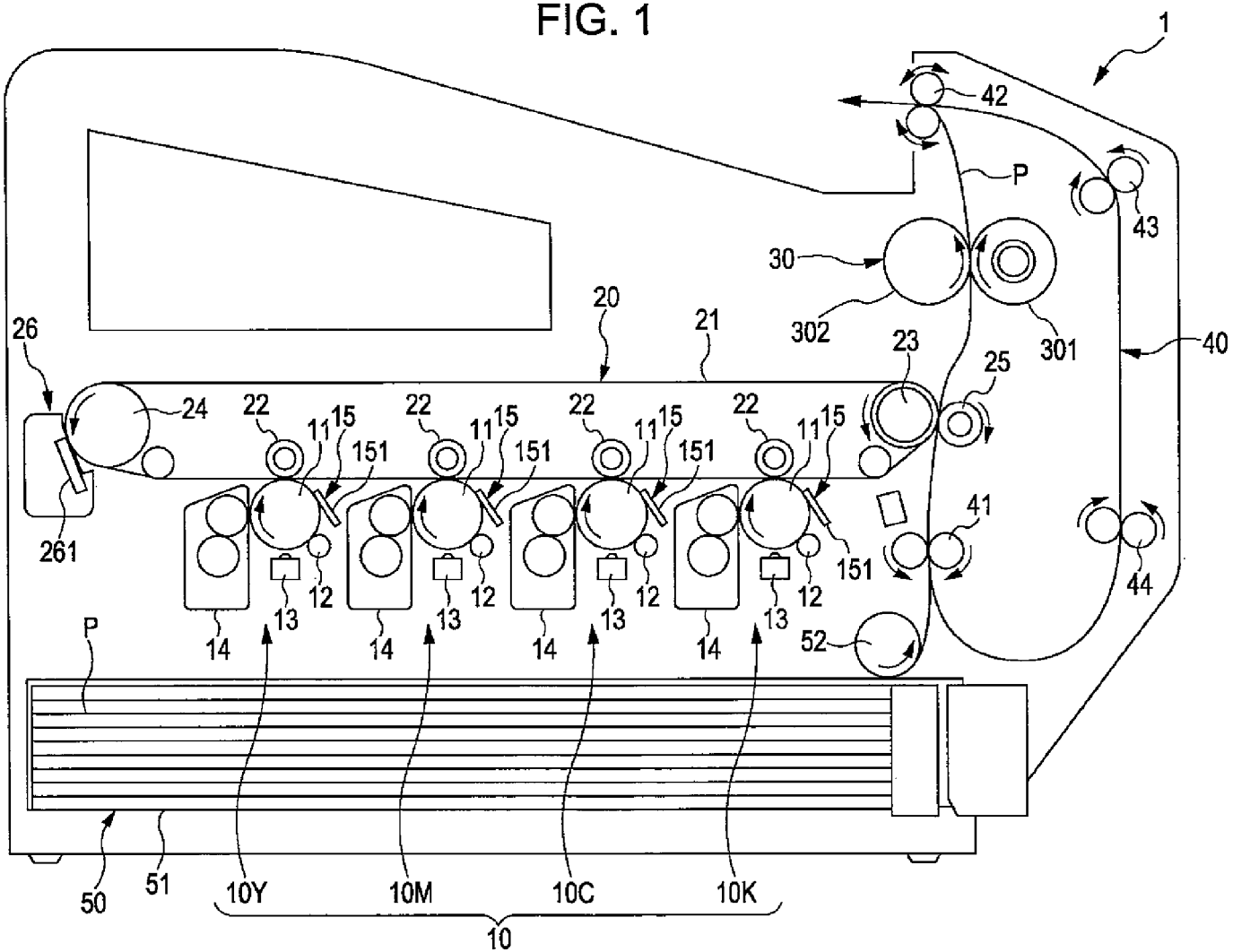
FIG. 1 is a schematic view showing the overall configuration of an image forming apparatus according to an embodiment of the invention.
Figure 2:
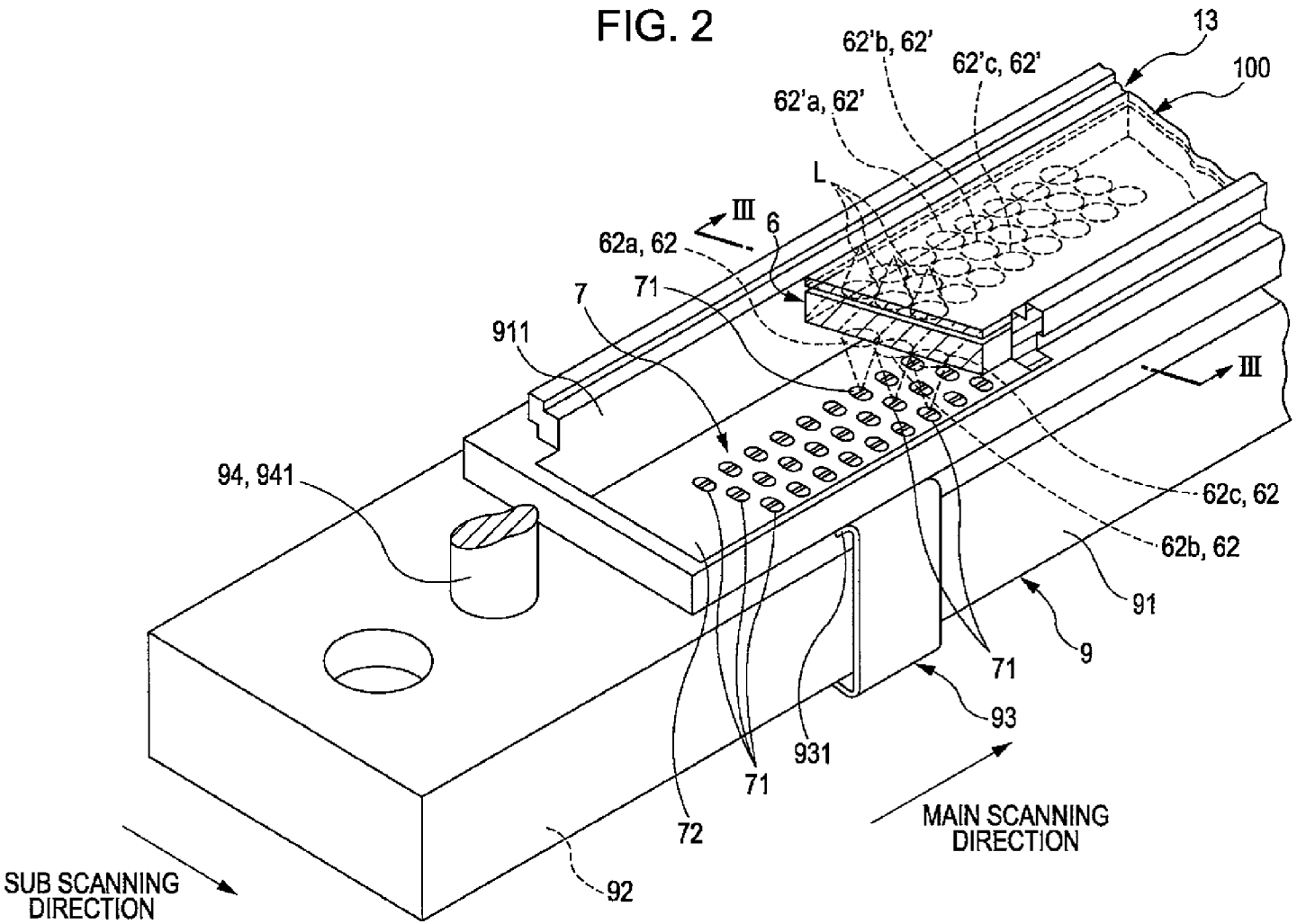
FIG. 2 is a partial cross-sectional perspective view of a line head included in the image forming apparatus shown in FIG. 1.
Figure 3:
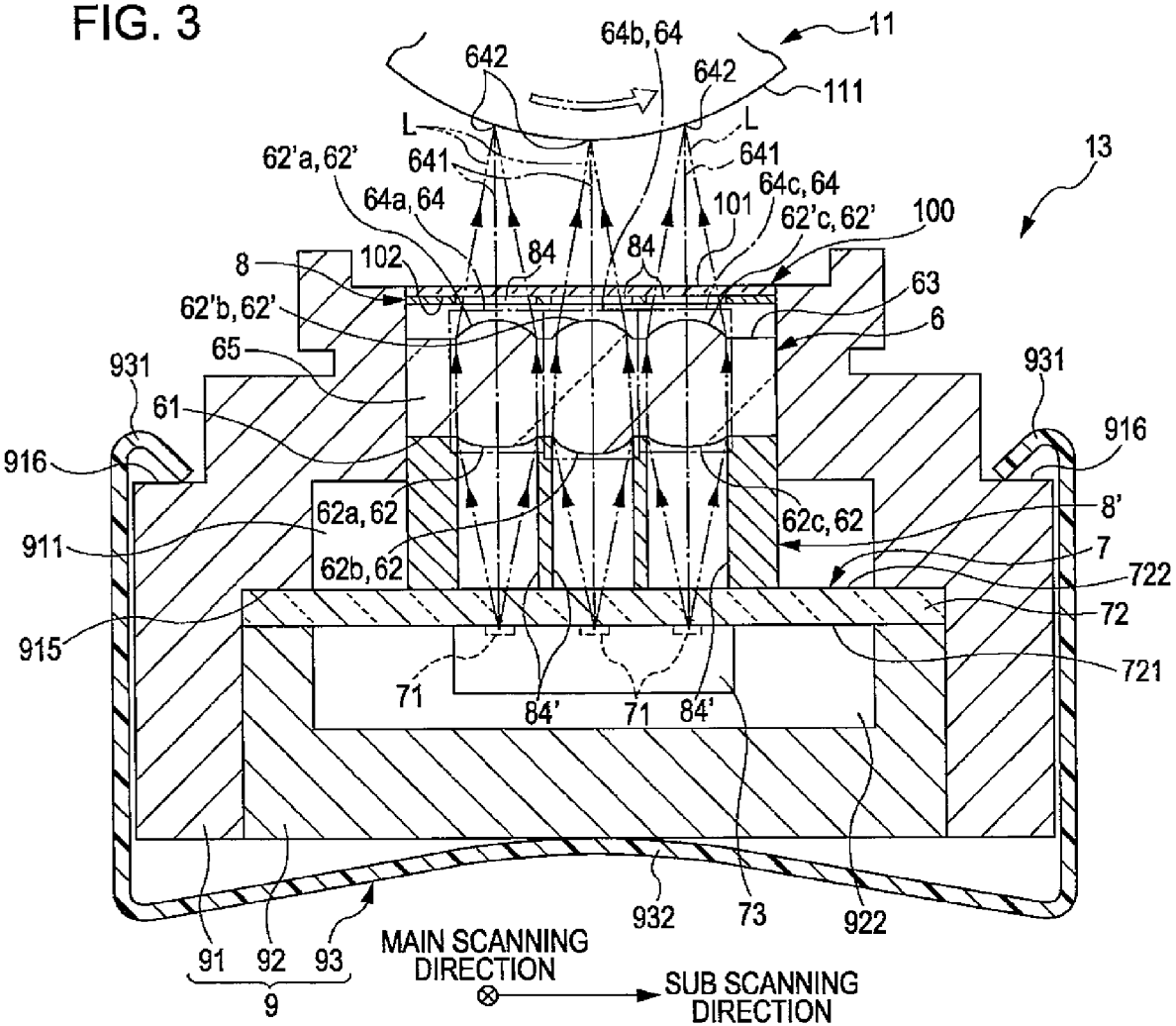
FIG. 3 is a cross-sectional view taken along line of FIG. 2.
Figure 4:
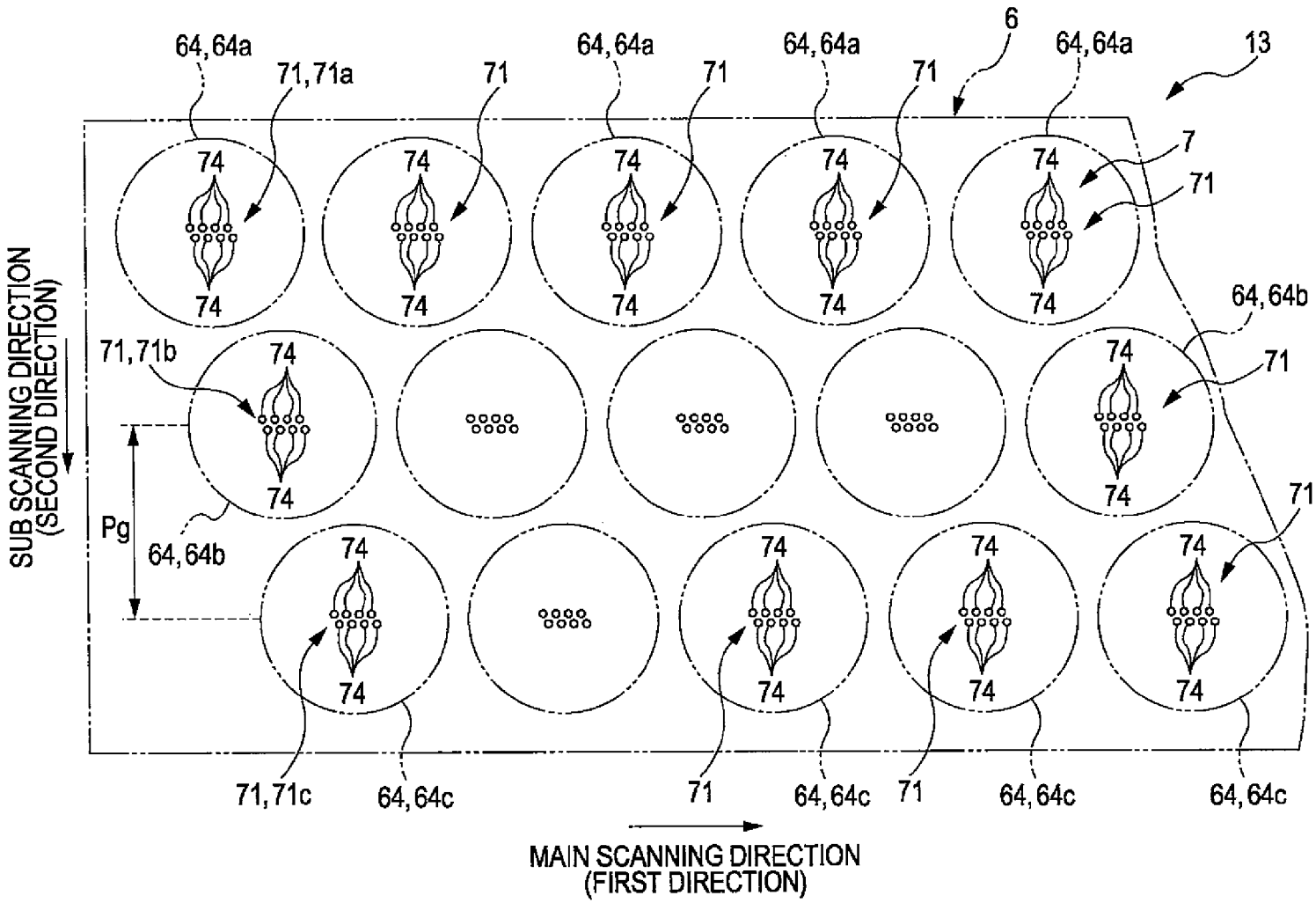
FIG. 4 is a view showing the positional relationship between a lens and a light emitting device when the line head shown in FIG. 2 is viewed in plan view.
Figure 5:
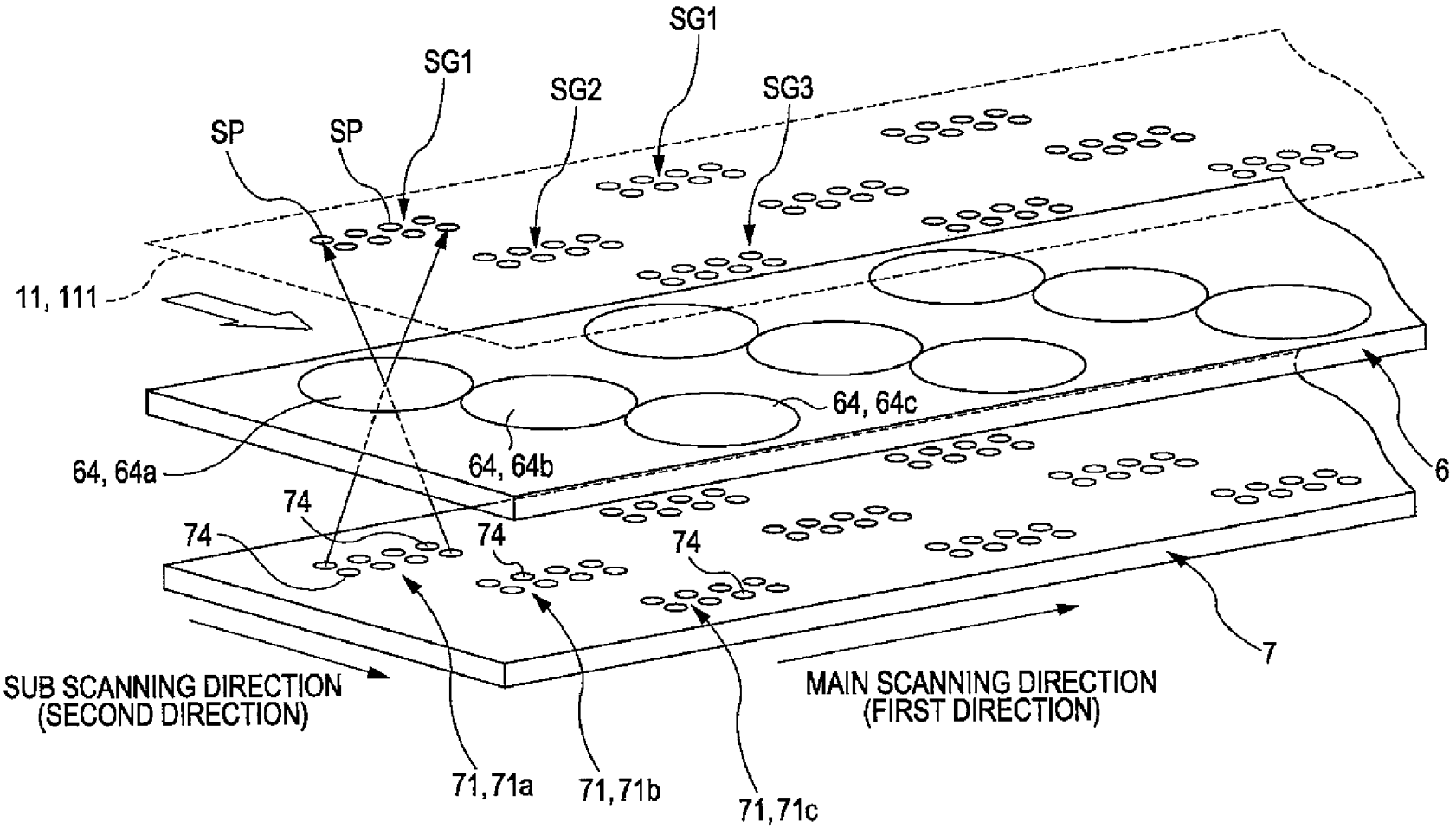
FIG. 5 is a schematic perspective view explaining the operation of the line head shown in FIG. 2.
Figure 6:
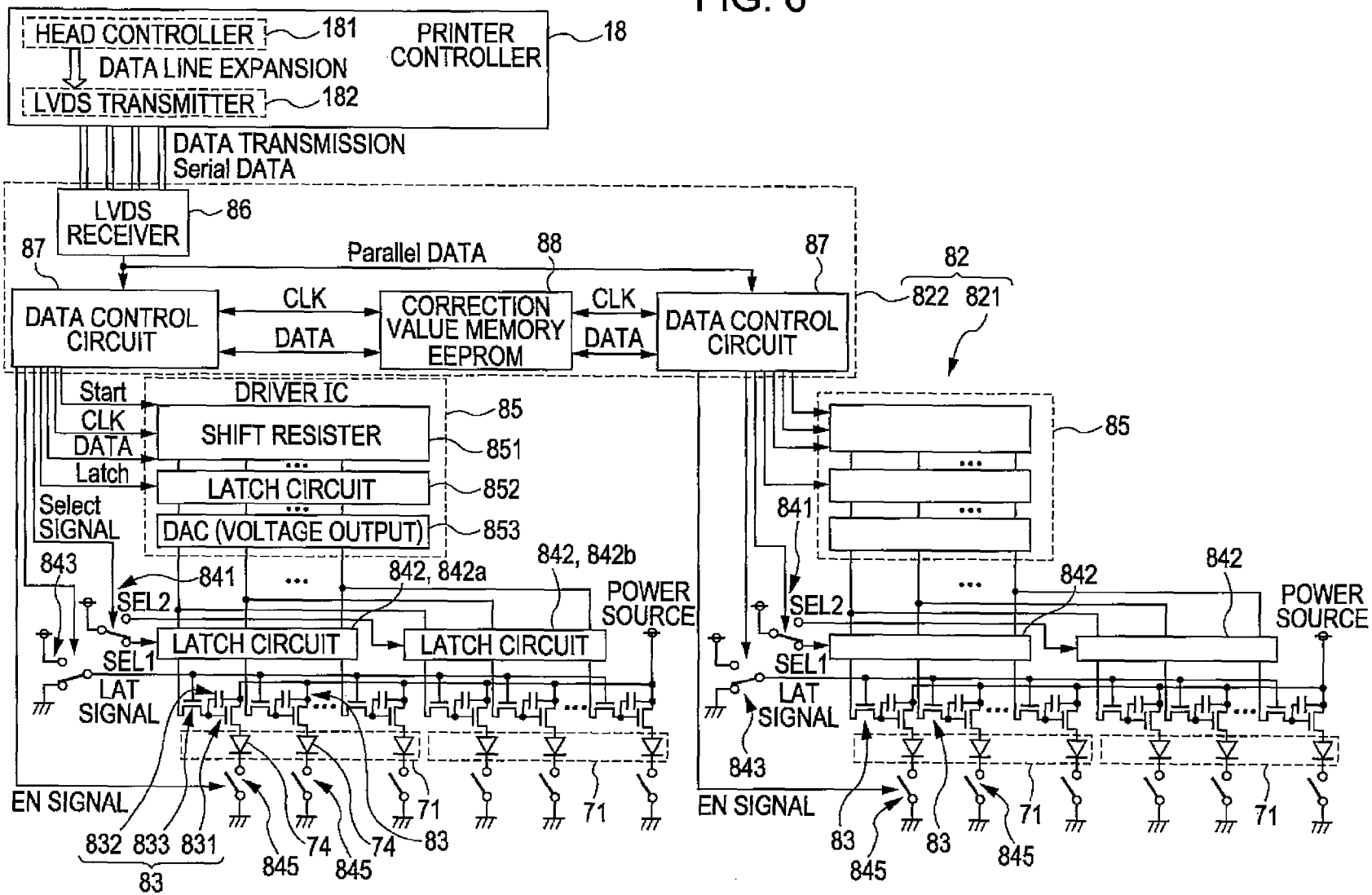
FIG. 6 is a view showing a control system of the line head shown in FIG. 2.
Figure 7:
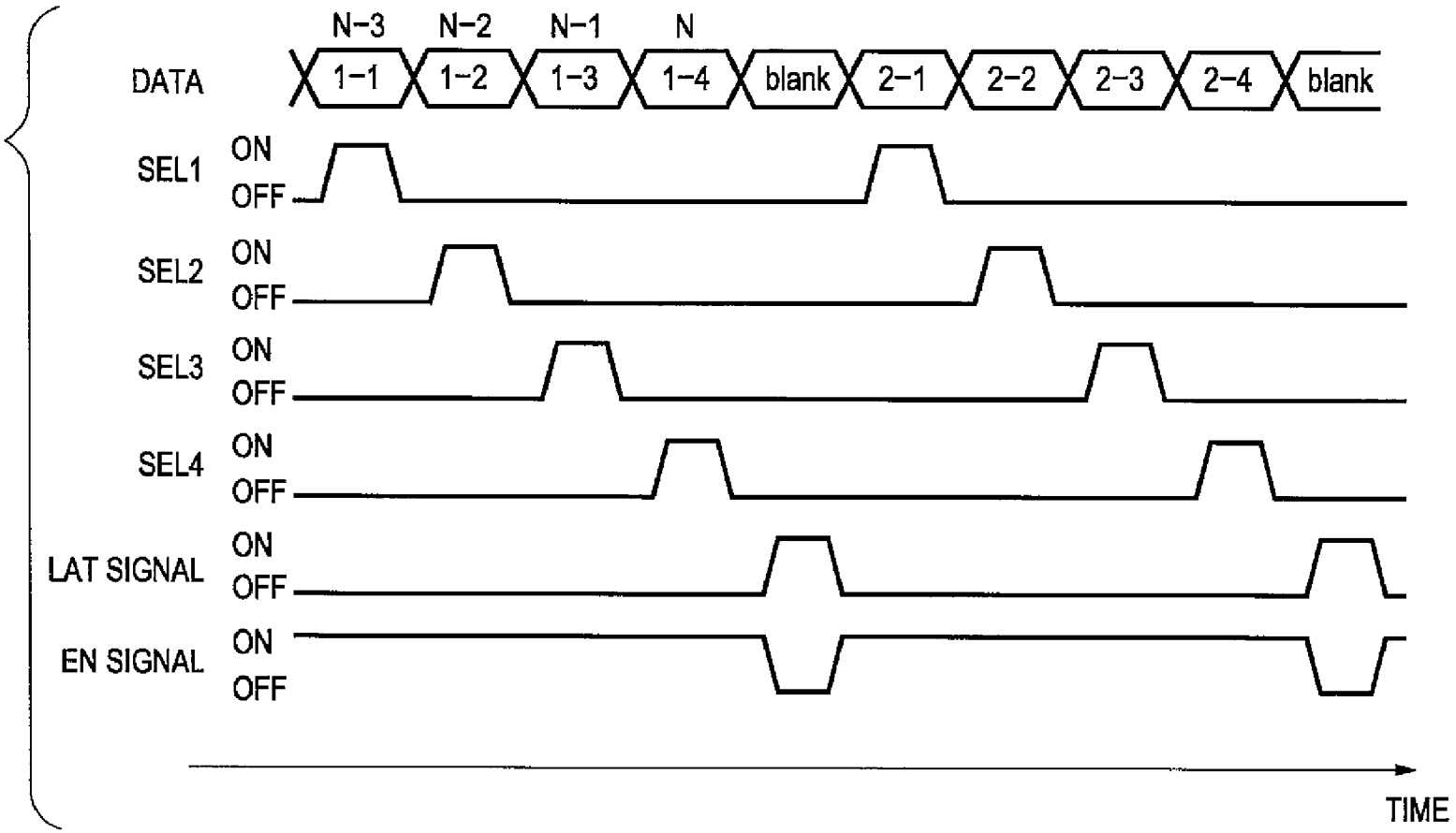
FIG. 7 is a timing chart explaining the operation of the control system shown in FIG. 6.
Figure 8:
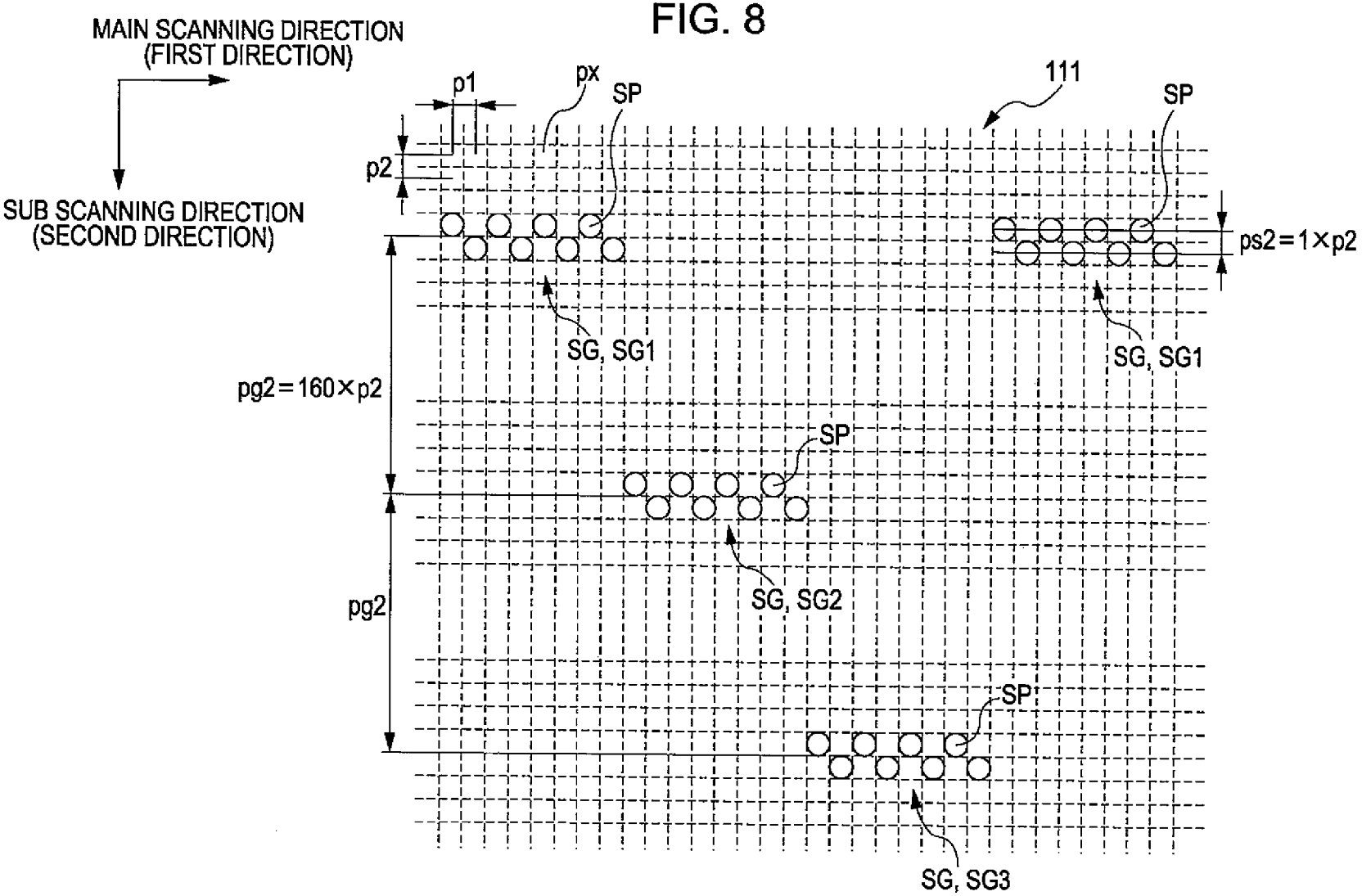
FIG. 8 is a view showing the arrangement of spots (spot latent image) formed on a latent image carrier by the line head shown in FIG. 2.

FIG. 1 is a schematic view showing the overall configuration of an image forming apparatus according to an embodiment of the invention. FIG. 2 is a partial cross-sectional perspective view of a line head included in the image forming apparatus shown in FIG. 1. FIG. 3 is a cross-sectional view taken along line of FIG. 2. FIG. 4 is a view showing the positional relationship between a lens and a light emitting device when the line head shown in FIG. 2 is viewed in plan view. FIG. 5 is a schematic perspective view explaining the operation of the line head shown in FIG. 2. FIG. 6 is a view showing a control system of the line head shown in FIG. 2. FIG. 7 is a timing chart explaining the operation of the control system shown in FIG. 6. FIG. 8 is a view showing the arrangement of spots (spot latent image) formed on a latent image, carrier by the line head shown in FIG. 2. Hereinafter, for convenience of description, the upper side of FIGS. 1 to 3, 5 and 6 is referred to as "upper" and the lower side thereof is referred to as "lower".

Image Forming Apparatus

The image forming apparatus 1 shown in FIG. 1 is an electrophotographic printer for recording an image on a recording medium P by a series of image forming processes including a charging process, an exposure process, a development process, a transfer process, and a fixing process. In the present embodiment, the image forming apparatus 1 is a so-called tandem-type color printer.

Such an image forming apparatus 1 includes, as shown in FIG. 1, an image forming unit 10 for the charging process, the exposure process and the development process, a transfer unit 20 for the transfer process, a fixing unit 30 for the fixing process, a transportation mechanism 40 for transporting the recording medium P such as paper, and a paper feed unit 50 for feeding the recording medium P to the transportation mechanism 40.

The image forming unit 10 includes four image forming stations including an image forming station 10Y for forming a yellow toner image, an image forming station 10M for forming a magenta toner image, an image forming station 10C for forming a cyan toner image, and an image forming station 10K for forming a black toner image.

Each of the image forming stations 10Y, 10C, 10M and 10K includes a photosensitive drum (photosensitive body) 11 for carrying an electrostatic latent image, and a charging unit 12, a line head (exposure unit) 13, a development device 14, and a cleaning unit 15 are arranged on the periphery (circumferential surface) thereof. The devices configuring the image forming stations 10Y, 10C, 10M and 10K substantially have the same configurations except that the colors of the used toners are different. Thus, hereinafter, one device will be described.

The photosensitive drum 11 has a cylindrical shape and is rotated around the axis thereof in a direction denoted by an arrow of FIG. 1. A photosensitive layer (not shown) is provided in the vicinity of the outer circumferential surface (cylindrical surface) of the photosensitive drum 11. The outer circumferential surface of the photosensitive drum 11 has a light receiving surface 111 for receiving light L (emitted light) from the line head 13 (see FIG. 2).

The charging unit 12 charges the light receiving surface 111 of the photosensitive drum 11 by corona charge or the like.

The line head 13 receives image information from a host computer such as a personal computer (not shown) and irradiates light L toward the light receiving surface 111 of the photosensitive drum 11 according to the image information. Similarly, when light L is irradiated to the light receiving surface 111 of the photosensitive drum 11 uniformly charged, a latent image (electrostatic latent image) corresponding to the irradiated pattern of the light L is formed on the light receiving surface 111. In addition, the configuration of the line head 13 will be described in detail later.

The development device 14 has a reservoir (not shown) for storing a toner, and supplies and applies the toner to the light receiving surface 111 of the photosensitive drum 11 for carrying the electrostatic latent image. To this end, the latent image on the photosensitive drum 11 is made visible (developed) as a toner image.

The cleaning unit 15 has a cleaning blade 151 which is in contact with the light receiving surface 111 of the photosensitive drum 11 and is made of rubber, and scraps and removes the toner remaining on the photosensitive drum 11 after a primary transfer by the cleaning blade 151.

The transfer unit 20 collectively transfers the toner images of the respective colors formed on the photosensitive drums 11 of the above-described image forming stations 10Y, 10M, 100 and 10K on the recording medium P.

In the image forming stations 10Y, 100, 10M and 10K, while the photosensitive drum 11 rotates once, the charging of the light receiving surface 111 of the photosensitive drum 11 by the charging unit 12, the exposure of the light receiving surface 111 by the line head 13, the supply of the toner to the light receiving surface 111 by the development device 14, the primary transfer onto an intermediate transfer belt 21 by the compression of a primary transfer roller 22, and the cleaning of the light receiving surface 111 by the cleaning unit 15 sequentially are performed.

The transfer unit 20 has the intermediate transfer belt 21 having an endless belt shape. The intermediate transfer belt 21 is stretched over a plurality (four in the configuration of FIG. 1) of primary transfer rollers 22, a driving roller 23 and a driven roller 24, and is rotated at substantially the same circumferential velocity as the circumferential velocity of the photosensitive drum 11 in the direction denoted by the arrow shown in FIG. 1 by the rotation of the driving roller 23.

Each of the primary transfer rollers 22 faces the photosensitive drum 11 corresponding thereto with the intermediate transfer belt 21 interposed therebetween, and a single-color toner image on the photosensitive drum 11 is transferred (primarily transferred) onto the intermediate transfer belt 21. A primary transfer voltage (primary transfer bias) having a polarity opposed to the charging polarity of the toner is applied to these primary transfer rollers 22.

On the intermediate transfer belt 21, the toner image of at least one of yellow, magenta, cyan and black is carried. For example, when forming a full-color image, four-color toner images of yellow, magenta, cyan and black sequentially are transferred so as to be superposed on the intermediate transfer belt 21, such that the full-color toner image is formed as an intermediate transfer image.

In addition, the transfer unit 20 includes a secondary transfer roller 25 which faces the driving roller 23 with the intermediate transfer belt 21 interposed therebetween and a cleaning unit 26 which faces the driven roller 24 with the intermediate transfer belt 21 interposed therebetween.

The secondary transfer roller 25 transfers (secondarily transfers) the single-color or full-color toner image (intermediate transfer image) formed on the intermediate transfer belt 21 on the recording medium P fed from the paper feed unit 50, such as paper, film or cloth. The secondary transfer roller 25 is pressed to the intermediate transfer belt 21 and a secondary transfer voltage (secondary transfer bias) is applied to the secondary transfer roller, during the secondary transfer. During the secondary transfer, the driving roller 23 functions as a backup roller of the secondary transfer roller 25.

The cleaning unit 26 has a cleaning blade 261 which is in contact with the surface of the intermediate transfer belt 21 and is made of rubber, and scraps and, removes the toner remaining on the intermediate transfer belt 21 after the secondary transfer by the cleaning blade 261.

The fixing unit 30 includes a fixing roller 301 and a pressurization roller 302 which is pressed in contact with the fixing roller 301, and the recording medium P passes between the fixing roller 301 and the pressurization roller 302. In addition, the fixing roller 301 has a heater mounted therein for heating the outer circumferential surface of the fixing roller so as to heat and pressurize the passing recording medium P. By the fixing unit 30 having such a configuration, the recording medium P, on which the toner image secondarily is transferred, is heated and pressurized such that the toner image is fused on the recording medium P so as to be fixed as a permanent image.

The transportation mechanism 40 includes a registration roller pair 41 for transporting the recording medium P while measuring paper feed timing to a secondary transfer portion between the secondary transfer roller 25 and the intermediate transfer belt 21 and transportation roller pairs 42, 43 and 44 for transporting the recording medium P fixed by the fixing unit 30.

When an image is formed only on one surface of the recording medium P, such a transportation mechanism 40 transports the recording medium P, one surface of which is fixed by the fixing unit 30, by the transportation roller pair 42 and ejects the recording medium to the outside of the image forming apparatus 1. When an image is formed on both surfaces of the recording medium P, the recording medium P, one surface of which is fixed by the fixing unit 30, is pinched by the transportation roller pair 42, the transportation roller pair 42 inversely is driven, the transportation roller pairs 43 and 44 are driven, the front and rear surfaces of the recording medium P are reversed so as to return to the registration roller 41, and an image is formed on the other surface of the recording medium P by the above-described operation.

The paper feed unit 50 includes a paper feed cassette 51 for receiving an unused recording medium P, and a pickup roller 52 for feeding the recording medium P from the paper feed cassette 51 toward the registration roller pair 41 one by one.

Line Head

Now, the line head 13 will be described. Hereinafter, for convenience of description, the longitudinal direction (first direction) of a lens array 6 which is elongated in an outer shape is referred to as a "main scanning direction" and the width direction (second direction) thereof is referred to as a "sub scanning direction".

As shown in FIG. 3, the line head 13 is disposed below the photosensitive drum 11 so as to face the light receiving surface 111. In this line head 13, cover glass (lens protection member) 100, a first light shielding member 8, a lens array 6, a second light shielding member 8' and a light emitting device array 7 sequentially are disposed from the side of the photosensitive drum 11, which are received in a casing 9.

In this line head 13, light L emitted from the light emitting device array 7 passes through a through-hole 84' of the second light shielding member 8', the lens array 6, a through-hole 84 of the first light shielding member 8 and the cover glass 100 in this order so as to be irradiated onto the light shielding surface 111 of the photosensitive drum 11.

As shown in FIGS. 2 and 4, the lens array 6 is composed of an elongated plate-shaped body.

As shown in FIG. 3, in the lens array 6, a plurality of first convex surfaces (lens surfaces) 62 is formed in a lower surface (incident surface) 61 of the lens array 6, to which the light L is incident. In addition, a plurality of second convex surfaces (lens surfaces) 62' is formed in a surface (emission surface) 63 of the lens array 6, from which the light L is emitted, so as to face the plurality of first convex surfaces 62.

That is, in the lens array 6, a plurality of lenses 64 which are biconvex lenses with the first convex surfaces 62 formed in the surface of the incident side of the light L and the second convex surfaces 62' formed in the surface of the emission side of the light L is disposed. The lens 64 configure an imaging optical system for imaging the light from light emitting devices 74 of a light emitting device group 71 corresponding thereto. In addition, a portion (mainly, peripheral portions of the lenses 64) other than the lenses 64 of the lens array 6 configure a lens support portion 65 supporting the lens 64.

As shown in FIGS. 2 and 4, the lens 64 are disposed in a plurality of columns in the main scanning direction (first direction) and are disposed in a plurality of rows in the sub scanning directions (second direction) perpendicular to the main scanning direction and the optical axis direction of the lens 64.

In more detail, the plurality of lenses 64 is disposed in a 3×n (n is an integer of 2 or more) matrix. In addition, among three lenses 64 belonging to one column (lens column), a lens 64 located at a central portion is called "lens 64*b*", a lens 64 located at the left side of FIG. 3 (upper side of FIG. 4) as called "lens 64*a*", and a lens 64 located at the right side of FIG. 3 (lower side of FIG. 4) is called "lens 64*c*". In addition, hereinafter, the convex surfaces of the incident surface and emission surface of light of the lens 64*a* respectively are called "first convex surface 62*a*" and "second convex surface 62'*a*", the convex surfaces of the light incident surface and emission surface of the lens 64*b* respectively are called "first convex surface 62*b*" and "second convex surface 62'*b*", and the convex surfaces of the light incident surface and emission surface of the lens 64*c* respectively are called "first convex surface 62*c*" and "second convex surface 62'*c*"

In the present embodiment, the line head 13 is mounted in the image forming apparatus such that, among the plurality of lenses 64 (64*a* to 64*c*) belonging to one column, a lens 64*b* closest to the central side of the sub scanning direction becomes closest to the light receiving surface 111 of the photosensitive drum 11. Accordingly, it is possible easily to set the optical characteristics of the plurality of lenses 64.

As shown in FIGS. 2 and 4, in each lens column, the lenses 64*a* to 64*c* sequentially are disposed so as to be shifted by the same distance in the main scanning direction (the right direction of FIG. 4). That is, in each lens column, lines for connecting the lens centers of the lens 64*a* to 64*c* are inclined by a predetermined angle in the main scanning direction and the sub scanning direction. The shift between the lenses 64 will be described in detail later.

A gap (pitch) between the lenses 64 in the sub scanning direction (second direction) is set to an integral multiple of an gap (pitch) p2 between the pixels PX of a latent image to be formed in the sub scanning direction (see FIGS. 4 and 8). Accordingly, it is possible relatively to simply set a spot SP and a spot group SG to become the below-described formation positions.

When viewed in the cross-sectional view shown in FIG. 3, three lenses 64 belonging to one lens column, that is, the lenses 64*a* to 64*c*, the lens axes 641 of the lens 64*a* and the lens 64*c* symmetrically are disposed with respect to the lens axis 641 of the lens 64*b*. In addition, the lenses 64*a* to 64*c* are disposed such that the lens axes 641 thereof are parallel.

The radii of curvature of the first convex surface 62 and the second convex surface 62' of the lenses 64*a* to 64*c* disposed as described above are set such that the focusing points (focal points) 642 of the lenses 64*a* to 64*c* are positioned on the light receiving surface 111 of the photosensitive drum 11.

In the present embodiment, the focal distance of the lens 64*a* and the focal distance of the lens 64*c* are equal to each other and the focal distance of the lens 64*b* is shorter than that of the lens 64*a* (lens 64*c*). Accordingly, the focal distance of the lens 64*a* (the lens 64*c*) and the focal distance of the lens 64*b* are different from each other. Since the lenses 64*a* to 64*c* have such a focal distance relationship, as described above, the lenses 64*a* to 64*c* image (focus) the light from the light emitting devices 74 of the light emitting device array 7 on the light receiving surface 111 of the photosensitive drum 11 in a state in which the lens 64*b* is mounted so as to be closest to the light receiving surface 111 of the photosensitive drum 11.

The optical characteristics of the lens 64*a* to 64*c* are obtained by equalizing the radii of curvature of the second convex surfaces 62' of the lenses 64*a* to 64*c*, equalizing the radii of curvature of the first convex surfaces 62 of the lens 64*a* and the lens 64*c*, and making the radii of curvature of the first convex surfaces 62 of the lens 64*a* (the lens 64*c*) and the lens 64*b* different. In detail, the radius of curvature of the first convex surface 62*b* of the lens 64*b* is smaller than that of the first convex surface 62*a* of the lens 64*a*.

Means for making the focal distance different is not limited to the above configuration. For example, the focal distance may be made different by equalizing the radii of curvature of the first convex surfaces 62 of the lenses 64*a* to 64*c*, equalizing the radii of curvature of the second convex surfaces 62' of the lens 64*a* and the lens 64*c*, and making different the radii of curvature of the second convex surfaces 62' of the lens 64*a* (the lens 64*c*) and the lens 64*b*.

The constituent material of the lenses 64 specially is not limited if the above-described optical characteristics can be obtained, but, for example, a resin material and/or a glass material suitably are used.

Various resin materials may be used as the resin material, for example, liquid crystal polymer such as polyamide, thermoplastic polyimide, polyamideimide aromatic polyester or the like; polyolefin such as polyphenylene oxide, polyphenylene sulfide, polyethylene or the like; polyester such as modified polyolefin, polycarbonate, (meth)acrylic, polymethylmethacrylate, polyethylene terephthalate, polybutylene terephthalate or the like; thermoplastic resin such as polyether, polyether ether ketone, polyetherimide, polyacetal or the like; thermosetting resin such as epoxy resin, phenol resin, urea resin, melamine resin, unsaturated polyester resin, polyimide resin or the like; or photo-curable resin may be used, and a combination of one type or two types or more thereof may be used.

Among such resin materials, when the thermosetting resin or the photo-curable resin is used, the following effect can be obtained. That is, such a resin material is advantageous in that a refractive index relatively is high, a thermal expansion coefficient relatively is low, and the material is hard to be expanded (deformed), modified or deteriorated due to heat.

As the glass material, various types of glass materials such as soda glass, crystallizable glass, quartz glass, lead glass, potassium glass, borosilicate glass, alkali-free glass or the like may be used. If the below-described support plate 72 configuring the light emitting device array 7 is made of a glass material, by using a glass material having substantially the same linear expansion coefficient as this glass material, it is possible to prevent the relative positions of the light emitting devices and the lenses from being shifted due to a variation in temperature.

For example, if the lens array 6 is formed of a combination of the above-described resin material and glass material, in a lamination structure in which a pair of resin layers formed of a resin material is formed on both surfaces of a glass substrate formed of a glass material, the first convex surfaces 62 are formed in the surface of one resin layer opposed to the glass substrate and the second convex surfaces 62' are formed in the surface of the other resin layer opposed to the glass substrate. The lens array 6 may be, for example, formed by forming a plurality of convex portions protruding in a convex surface shape in both surfaces of a flat plate-shaped member (substrate) of which the upper surface and the lower surface are flat surfaces. In this case, from the viewpoint of the facilitation of manufacture and the securing of the rigidity of the lens array 6, it is preferable that the flat plate-shaped member is formed of, for example, a glass material and the convex portions are formed of a resin material.

As shown in FIGS. 2 and 3, the cover glass (lens protection member) 100 is mounted on the emission side of the light L of the lens array 6.

The cover glass 100 prevents a foreign matter from being attached to the emission surface of the light L of the lens array 6 and is formed of a plate-shaped body which is elongated in an outer shape. In addition, in the cover glass 100, an upper surface (emission surface) 101 from which the light L is emitted and a lower surface (incident surface) 102 to which the light L is incident are flat surfaces.

The cover glass 100 is disposed so as to be parallel to or substantially parallel to the lens array 6.

The cover glass 100 is disposed such that the lower surface 102 thereof and the second convex surfaces 62' of the lens array 6 are separated from each other. By disposing the cover glass so as to be separated from the second convex surfaces 62' of the lens array 6, involuntary pressure is applied from the cover glass 100 to the second convex surfaces 62' of the lens array 6 so as to deform the second convex surfaces 62', thereby preventing the optical characteristics of the lenses 64 from deteriorating.

The cover glass 100 is formed of a glass material. By forming the glass material, it is possible easily to eliminate the attached foreign matter and efficiently prevent the upper surface 101 from being scratched during cleaning.

The upper surface 101 of the cover glass 100 may be subjected to an antifouling treatment. As the antifouling treatment, a treatment for preventing or suppressing the surface 101 from being contaminated or a treatment easily for eliminating contamination even when the upper surface 101 is contaminated. As such an antifouling treatment, for example, there is a method for applying a fluorine-containing silane compound on the upper surface 101 by a dipping method (for example, see JP-A-2005-3817).

The upper surface 101 of the cover glass 100 may be subjected to a flaw resistance treatment. As the flaw resistance treatment, for example, there is a method for forming a layer mainly formed of C6H14 and C2F6 on the surface 101 by a vapor-phase film-forming method such as a high-frequency plasma CVD method (for example, see JP-A-2006-133420).

When the antifouling treatment or the flaw resistance treatment is performed with respect to the upper surface 101 of the cover glass 100, it is possible easily to perform the treatment since the upper surface 101 is the flat surface. Since the upper surface 101 is the flat surface, the layer formed by the antifouling treatment or the flaw resistance treatment uniformly can be formed on the upper surface 101.

In addition, the cover glass 100 may not be separated from the lens array 6 and, for example, may be in contact with the Second convex surfaces 62' of the lens array 6. By such a configuration, the lens array 6 and the cover glass 100 are positioned with certainty. In addition, the cover glass 100 may be omitted. In this case, it is preferable that the surface on the emission side of light of the lens array 6 may be subjected to the above-described antifouling treatment or the flaw resistance treatment.

As shown in FIG. 3, the first light shielding member 8 is mounted between the lens array 6 and the cover glass 100. The first light shielding member 8 has a function for preventing crosstalk of the light L between adjacent lenses 64 and eliminating unnecessary light transmitting through an area in which the lenses 64 of the lens array 6 are not provided.

The first light shielding member 8 is formed on the lower surface 102 of the above-described cover glass 100 as a film. By such a configuration, it is possible easily to form the first light shielding member 8. By forming the film, it is possible thinly to form the first light shielding member 8 with low cost.

In the first light shielding member 8, a plurality of through-holes (openings) 84 penetrating through the first light shielding member 8 in a vertical direction (thickness direction) of FIG. 3 is formed. These through-holes 84 are disposed at positions corresponding to the lenses 64. The through-holes 84 have a circular shape in plan view and pass the emitted light from the lenses 64.

The material of the first light shielding member 8 specially is not limited if light is not transmitted and, for example, various types of coloring agents or a metal-based material such as chrome, or chrome oxide, or a resin obtained by kneading carbon black or a coloring agent may be used.

The first light shielding member 8 may have a plate shape or a block shape, instead of the film shape.

As shown in FIG. 3, the light emitting device array 7 is mounted on the incident side of the light L of the lens array 6 with the second light shielding member 8'. The light emitting device array 7 has a plurality of light emitting devices groups 71 and a support plate (head substrate) 72.

The support plate 72 supports the light emitting device groups 71 and is formed of a plate-shaped body which is elongated in an outer shape. The support plate 72 is disposed in parallel to the lens array 6.

The length of the support plate 72 in the main scanning direction is longer than that of the lens array 6 in the main scanning direction. The length of the support plate 72 in the sub scanning direction is set to be longer than that of the lens array 6 in the sub scanning direction.

The constituent material of the support plate 72 specially is not limited and, if the light emitting device groups 71 are provided on the rear surface side of the support plate 72 as in the present embodiment (the case of using bottom emission type light emitting devices as the light emitting device 74), a transparent material such as various types of glass materials or various types of plastic suitably is used. If top emission type light emitting devices are used as the light emitting devices 74, the constituent material of the support plate 72 is not limited to the transparent material and, for example, various types of metal materials such as aluminum or stainless steel, various types of glass materials or various types of plastic may be used solely or in combination. If the support plate 72 is formed of various types of metal materials or various types of glass materials, it is possible efficiently to radiate heat generated by light emission of the light emitting devices 74 through the support plate 72. If the support plate 72 is formed of various types of plastic, it is possible to reduce the weight of the support plate 72.

A box-shaped reception portion 73 opened toward the side of the support plate 72 is mounted on the rear surface side of the support plate 72. In the reception portion 73, the plurality of light emitting device groups 71, wires (not shown) which electrically are connected to the light emitting device groups 71 (the light emitting devices 74) or a circuit (not shown) for driving the light emitting devices 74 are received.

The plurality of light emitting device groups 71 are separated from each other in correspondence with the above-described plurality of lenses 64 and are disposed in a 3×n (n is an integer of 2 or more) matrix (for example, see FIG. 4). Each of the light emitting device groups 71 includes a plurality (eight in the present embodiment) of light emitting devices 74.

As shown in FIG. 3, the eight light emitting devices 74 configuring each of the light emitting device groups 71 are disposed along the lower surface 721 of the support plate 72. The light L emitted from the light emitting devices 74 is focused (imaged) on the light receiving surface 111 of the photosensitive drum 11 through the lenses 64 corresponding thereto. In addition, although described later, the light L emitted from the light emitting devices 74 exposes the light receiving surface 111 so as to form spots SP (see FIGS. 5 and 8). In addition, a spot group SG is formed by eight spots SP corresponding to one light emitting device group 71. Since the lenses 64 are disposed between the light emitting device groups 71 and the light receiving surface 111, the eight light emitting devices 74 belonging to one light emitting device group 71 and the bight spots SP corresponding thereto are reversed in the left and right positional relationship in FIG. 5.

As shown in FIG. 4, the eight light emitting devices 74 are separated from each other, are disposed in four columns in the main scanning direction, and are disposed in two rows in the sub scanning direction. The eight light emitting devices 74 have a 2×4 matrix shape. The adjacent two light emitting devices 74 belonging to one column (light emitting device column) are disposed so as to be shifted in the main scanning direction.

In the eight light emitting devices 74 having a 2×4 matrix shape, the light emitting devices 74 adjacent in the main scanning direction one light are complemented by one light emitting device 74 of a next row.

The disposition of the eight light emitting devices 74 in one row as dense as possible has limitations. However, by disposing the eight light emitting devices 74 so as to be shifted as described above, it is possible to increase the disposition density of the light emitting devices 74. Accordingly, when an image is recorded on a recording medium P, it is possible to increase the recording density of the recording medium P. Therefore, it is possible to obtain a recording medium P in which a clear image is carried with high resolution and multiple gradations.

In particular, in the present embodiment, when the eight light emitting devices 74 belonging to each of the light emitting device groups 71 simultaneously emit light, as shown in FIG. 8, a gap (pitch) ps2 between the spots SP, which are formed by imaging the light from the light emitting devices 71 by the lenses 64, in the sub scanning direction (second direction) is set to an integral multiple of a gap (pitch) p2 between pixels PX of a latent image to be formed in the sub scanning direction. Accordingly, as described below, the eight light emitting devices 74 simultaneously emit light (simultaneously light up) so as to form a desired latent image. Since the switch of the light emission of the light emitting devices 74 is unnecessary as in the case where the eight light emitting devices 74 sequentially emit light, it is possible to realize a high-accuracy exposure process.

Such a gap (pitch) ps2 specially is not limited, but preferably is nearly equal to (one to three times of) the gap (pitch) p2.

In addition, although the eight light emitting devices 74 belonging to one light emitting device group 71 are disposed in a 2×4 matrix in the present embodiment, the invention is not limited thereto, and the light emitting devices may be disposed in a 4×2 matrix.

As described above, the plurality of light emitting device groups 71 are separated from each other and are disposed in a 3×n matrix. As shown in FIG. 4, three light emitting device groups 71 belonging to one column (light emitting device group column) are disposed so as to be shifted at the same gap in the main scanning direction (the right direction of FIG. 4).

In the light emitting device groups 71 having a 3×n matrix shape, the gaps between the adjacent light emitting device groups 71 sequentially are complemented by the light emitting device groups 71 of a next row and the light emitting device groups 71 of a next row thereof.

The disposition of the plurality of light emitting device groups 71 in one row as dense as possible has limitations. However, by disposing the plurality of light emitting device groups 71 so as to be shifted as described above, it is possible to increase the disposition density of the light emitting device groups 71. Accordingly, by disposing the eight light emitting devices 74 in one light emitting device group 71 so as to be shifted, it is possible to increase the recording density of a recording medium P when an image is recorded on the recording medium P. Therefore, it is possible to obtain a recording medium P in which a clearer image is carried with high resolution, multiple gradations and excellent color reproducibility.

In particular, in the present embodiment, when the plurality of light emitting devices 74 belonging to each of the plurality of light emitting device groups 71 simultaneously emit light, a gap (pitch) pg2 between the spot groups SG, which are formed by imaging the light from the light emitting device groups 71 by the lenses 64, in the sub scanning direction (second direction) is set to an integral multiple of a gap (pitch) p2 between pixels PX of a latent image to be formed in the sub scanning direction. Accordingly, as described below, the light emitting devices 74 simultaneously emit light by different light emitting device groups 71 so as to form a desired latent image. Since the switch of the light emission of the light emitting devices 74 is unnecessary as in the case where the light emitting devices 74 sequentially emit light between the plurality of light emitting device groups 71, it is possible to realize a high-accuracy exposure process.

Such a gap (pitch) pg2 specially is not limited, but preferably is 160 times (50 to 200 times) of the gap (pitch) p2.

Although described later, the light emitting device groups 71 belonging to the same row (light emitting device row) and the light emitting devices 74 are lit up/turned off at the same timing. In the present embodiment, all the light emitting devices 74 provided on the support plate 72 are lit up/turned off at the same timing.

The light emitting devices 74 are organic EL devices (organic electroluminescence devices) having a bottom emission structure. In addition, the light emitting devices 74 are not limited to the devices having the bottom emission structure and may be a device having a top emission structure. In this case, as described above, the support plate 72 does not require a light transmission property.

If the light emitting devices 74 are the organic EL devices, it is possible to set the gap (pitch) between the light emitting devices 74 relatively to be small. Thus, when an image is recorded on a recording medium P, the recording density of the recording medium P relatively is high. In addition, it is possible to form the light emitting devices 74 with high-accuracy dimension and position using various types of film forming methods. Accordingly, it is possible to obtain a recording medium P in which a clearer image is carried.

In the present embodiment, all the light emitting devices 74 emit red light. As the constituent material of the light emitting layer for emitting red light, for example, there is (4-dicyanomethylene)-2-methyl-6(paradimethylaminostyryl)-4H-pyran (DCM), Nile Red, or the like. In addition, the light emitting devices 74 may emit single-color light having the other color or white light, instead of red light. In the organic EL devices, the light L emitted from the light emitting layer properly may be set to single-color light having any color according to the constituent material of the light emitting layer.

The spectral sensitivity characteristics of the photosensitive drum used in an electrophotographic process are set to have a peak in a near-infrared region from a red color which is the emitted light wavelength of a semiconductor laser, a red light emitting material preferably is used as described above.

As shown in FIG. 3, the second light shielding member 8' is mounted between the lens array 6 and the light emitting device array 7. The second light shielding member 8' is used to prevent the crosstalk of the light L between adjacent light emitting device groups 71.

The second light shielding member 8' is formed of a block body which is elongated in an outer shape. A plurality of through-holes 84' penetrating through the second light shielding member 8' in a vertical direction (thickness direction) of FIG. 3 is formed in the second light shielding member 8' formed of the block body. These through-holes 84' are disposed at positions corresponding to the lenses 64 so as to form optical paths from the light emitting device groups 71 to the lenses 64 corresponding thereto. The through-holes 84' have a circular shape in plan view and includes the eight light emitting devices 74 of each of the light emitting device groups 71 corresponding to the through-holes 84' therein.

The through-holes have a cylindrical shape in the configuration shown in FIG. 3, but the invention is not limited thereto. For example, the through-holes may have a cone shape which widens upwardly.

The upper end surface and the lower end surface of the second light shielding member 8' are flat surfaces and are parallel to each other. The upper end surface of second light shielding member 8' is in contact with the lower surface 61 of the lens array 6, and the lower end surface thereof is in contact with the upper surface 722 of the support plate 72 of the light emitting device array 7. Accordingly, the second light shielding member 8' may define the distance, the positional relationship and the posture between the lens array 6 and the support plate 72 with high accuracy.

The distance between the first convex surfaces 62 of the lenses 64 and the light emitting device groups 71 corresponding thereto is an important factor (element) for deciding the vertical, position of a focusing point 642 in FIG. 3. Accordingly, as described above, if the second light shielding member 8' functions as a spacer for regulating a gap length which is the distance between the lens array 6 and the light emitting device array 7, it is possible to obtain an image forming apparatus 1 with high reliability and high accuracy.

The second light shielding member 8' and the lens array 6 and/or the support plate 72 may be fixed by, for example, adhesion (adhesion using an adhesive or a solvent).

Both ends of the through-holes 84' are sealed by the first convex surfaces 62 of the lenses 64 corresponding to the through-holes 84' and the upper surface 722 of the support plate 72 of the light emitting device array 7 so as to be shielded from light. That is, in the line head 13, a closed space which is shield from light is formed by the inner circumferential surfaces of the through-holes 84', the first convex surfaces 62 of the lenses 64 corresponding to the through-hole 84', and the upper surface 722 of the support plate 72.

By forming the closed space which is shielded from light, the light L from the light emitting devices 74 is incident to the lenses 64 corresponding thereto with certainty. In detail, the light L from the light emitting devices 74 is incident only to the lenses 64 corresponding to the light emitting devices 74 so as to prevent from being incident to, for example, adjacent different lenses 64. That is, it is possible to prevent the crosstalk of the light L between the adjacent light emitting device groups 71 with certainty.

Since a foreign matter is prevented from entering the closed space, the foreign matter is prevented from being attached to the first convex surfaces 62. Accordingly, the first convex surfaces 62 purely are maintained.

In the second light shielding member 8', at least the inner circumferential surfaces of the through-holes 84' are colored by a dark color such as black, ginger, or mazarine. Therefore, when the light L passes through the through-holes 84', it is possible to prevent the light from being reflected from the inner circumferential surfaces 841' of the through-holes 84'. Accordingly, when the light L is reflected from the inner circumferential surfaces 841', it is possible to prevent the reflected light L from being incident to the other lenses 64 or prevent image blurring from occurring without imaging the light L on a portion to be imaged of the light receiving surface 111 even when the light is not incident to the other lenses 64.

The constituent material of the second light shielding member 8' specially is not limited, but, for example, the same constituent material as the support plate 72 may be used.

As shown in FIGS. 2 and 3, the lens array 6, the light emitting device array 7, the cover glass 100, the first light shielding member 8 and the second light shielding member 8' collectively are received in the casing 9. This casing 9 has a frame member (casing body) 91, a cover member (rear cover) 92, and a plurality of clamp members 93 for fixing the cover member 92 to the frame member 91 (see FIG. 3).

As shown in FIGS. 2, 5 and 6, the frame member 91 is elongated in the whole shape.

The frame member 91 has a frame shape and, as shown in FIG. 3, an internal cavity 911 opened upwardly and downwardly is formed in the frame member 91. The width of the internal cavity 911 is stepwise reduced from the lower side to the upper side of FIG. 3.

The cover glass 100, the first light shielding member 8, the lens array 6, the second light shielding member 8' and the light emitting device array 7 are inserted into the internal cavity 911 and are fixed by, for example, an adhesive. Accordingly, the cover glass 100, the first light shielding member 8, the lens array 6, the second light shielding member 8' and the light emitting device array 7 collectively are held in the frame member 91, and cover glass 100, the first light shielding member 8, the lens array 6, the second light shielding member 8' and the light emitting device array 7 are positioned in the main scanning direction and the sub scanning direction.

The upper surface 722 of the support plate 72 of the light emitting device array 7 is adhered to (in contact with) a step difference 915 formed on the wall surface of the internal cavity 911 and the lower surface 82' of the second light shielding member 8'. The cover member 92 is inserted into the internal cavity 911 from the lower side thereof.

The cover member 92 includes an elongated member having a concave portion 922, into which a reception portion 73 is inserted, on the upper side thereof. The edge of the support plate 72 of the light emitting device array 7 is pinched between the upper end surface of the cover member 92 and the boundary 915 of the frame member 91.

The cover member 92 is pressed upwardly by the clamp members 93. Accordingly, the cover member 92 is fixed to the frame member 91. The positional relationship among the light emitting device array 7, the second light shielding member 8' and the lens array 6 in the main scanning direction, the sub scanning direction and the vertical direction of FIG. 3 is fixed by the pressed cover member 92.

The plurality of clamp members 93 preferably is disposed at the same gap along the main scanning direction. Accordingly, the frame member 91 and the cover member 92 uniformly can be pinched along the main scanning direction.

The clamp members 93 substantially have a U shape in the cross-sectional view shown in FIG. 3 and is formed by bending a metal plate. In both ends of the clamp members 93, claws 931 bent inward are formed. The claws 931 are engaged with a shoulder 916 of the frame member 91.

Curved portions 932 curved upwardly in an arch shape are formed in the intermediate portions of the clamp members 93. The tops of the curved portions 932 are pressed in contact with the lower surface of the cover member 92 in a state in which the claws 931 are engaged with the shoulder 916 as described above. Accordingly, the curved portions 932 bias the cover member 92 upwardly elastically in an deformed state.

When the clamp members 93 pinches the frame shape 91 and the cover member 92 are detached, the cover member 92 may be separated from the frame member 91. Accordingly, it is possible to perform maintenance such as exchange, repair or the like of the light emitting device array 7.

The constituent material of the frame member 91 and the cover member 92 specially is not limited and, for example, the same constituent material as the support plate 72 may be used. As the constituent material of the clamp member 93 specially is not limited, but, for example, aluminum or stainless steel may be used. The clamp members 93 may be formed of a hard resin material.

Although not shown, spacers protruding upwardly are provided on both ends of the longitudinal direction of the frame member 91. The spacers regulate the distance between the light receiving surface 111 and the lens array 6.

Next, the control system of the line head 13 will be described.

As shown in FIG. 6, the line head 13 has a circuit unit 82. The circuit unit 82 includes a driving circuit 821 for driving the light emitting devices 74 and a control circuit 822 for controlling the operation of the driving circuit 821.

The driving circuit 821 has a so-called multiplex function so as to drive the above-described light emitting devices 74.

In the present embodiment, the driving circuit 821 includes a plurality of constant current driving circuits 83, which is provided in correspondence with the light emitting devices 74, for holding a gate voltage, a selection switch 841, a plurality of latch circuits 842 provided in correspondence with the light emitting device groups 71, a latch switch 843, enable switches 845, a plurality of driver ICs 85 (output units) provided in correspondence with the predetermined number of light emitting device groups 71.

Each of the constant current driving circuits 83 has a constant current transistor 831, a voltage holding capacitor 832 and a selection transistor 833.

In each of the constant current driving circuits 83, when the selection transistor 833 is turned on, constant current according to the driving signals of the driver ICs 85 (the voltage passing through the latch circuit 842) flows in the light emitting devices 74 through the constant current transistor 831 such that the light emitting devices 74 emit light. In addition, since the driving signals of the driver ICs 85 (the voltage passing through the latch circuit 842) are held in the voltage holding capacitors 832, the current continuously flows in the light emitting devices 74 for a predetermined time even when the selection transistor 833 is turned off such that the emission of the light emitting devices 74 is held.

The selection switch 841 is switched to SEL1 and SEL2 by a select signal from the control circuit 822 so as to select the latch circuits 842 to which the driving signals from the driver ICs 85 is input. By switching the selection switch 841, it is possible to set the voltages applied to the light emitting devices 74 for each of the light emitting device groups 71. In FIG. 6, the latch circuits 842 to which the driving signals from the driver ICs 85 are input are latch circuits 842*a* when the selection switch 841 is SEL1, and the latch circuits 842 to which the driving signals from the driver ICs 85 are input are latch circuits 842*b* when the selection switch 841 is SEL2.

The plurality of latch circuits 842 is provided in correspondence with the light emitting device groups 71. The latch circuits 842 hold the driving signals (voltage) output from the driver ICs 85 and, in more detail, hold the signal for driving the plurality of light emitting devices 74 belonging to the light emitting device group 71 corresponding thereto.

The latch switch 843 has a function for switching ON/OFF of the latch circuits 842. In particular, the latch switch 843 concurrently (simultaneously) switches ON/OFF of the plurality of latch circuits 842. For example, in one main scanning operation, the latch switch 843 is turned off until all the plurality of latch circuits 842 hold the signal as described and is then turned on. Accordingly, the plurality of light emitting devices 74 belonging to the different light emitting device groups 71 simultaneously can emit light. In addition, the light emitting devices 74 of the entire light emitting device groups 71 (light emitting devices 74) simultaneously can emit light. The latch switch 843 is switched to the ON state and the OFF state by the above-described control circuit 822.

At this time, the switch of the enable switches 845 is performed by the above-described control circuit 822 in synchronization with the latch switch 843 (substantially at the same timing).

The enable switches 845 are provided in correspondence with the light emitting devices 74 and have a function for switching to the ON state in which the light emitting devices 74 corresponding thereto can emit light and the OFF state in which the light emitting devices corresponding thereto cannot emit light. The enable switches 845 are turned off when the above-described latch switch 843 is turned on and are turned on when the latch switch 843 is turned off. Accordingly, the light emitting devices 74 of the different light emitting device groups 71 simultaneously can emit light at high-accuracy timing.

Now, the simultaneous lighting of all the light emitting devices 74 will be described in more detail with respect to FIG. 7. In FIG. 6, for convenience of description, some portions are not shown and two light emitting device groups 71 are connected to one driver IC 85. In FIG. 7, the case where four light emitting device groups 71 are connected to one driver IC 85 is shown. In the following description, the case where four light emitting device groups 71 are connected to one driver IC 85 will be described. The latch circuits 842 to which the driving signals from the driver ICs 85 are input when the selection switch 841 is SEL1 are the latch circuits 842*a*, the latch circuits 842 to which the driving signals from the driver ICs 85 are input when the selection switch 841 is SEL2 are the latch circuits 842*b*, the latch circuits 842 to which the driving signals from the driver ICs 85 are input when the selection switch 841 is SEL3 are the latch circuits 842*c*, and the latch circuits 842 to which the driving signals from the driver ICS 85 are input when the selection switch 841 is SEL4 are the latch circuits 842*d*.

First, DATA1-1 is output as a first (N−3rd) driving signal from DACs 853 of the driver ICs 85 (output units), and the state of the selection switch 841 becomes SEL1 by the select signal such that DATA1-1 is latched (held) in the latch circuits 842*a*. At this time, the latch switch 843 is turned off and the enable switches 845 are turned on. Similarly, in the output of DATA1-2 to 1-4, the latch switch 843 is turned off and the enable switches 845 are turned on.

Next, DATA1-2 is output as a second (N−2th) driving signal from DACs 853 in a state in which the DATA1-1 is latched (held) in the latch circuits 842*a*, and the state of the selection switch 841 becomes SEL2 by the select signal such that, DATA1-2 is latched (held) in the latch circuits 842*b*.

Next, DATA1-3 is output as a third (N−1)th driving signal from DACs 853 in a state in which the DATA1-1 is latched (held) in the latch circuits 842*a* and DATA1-2 is latched (held) in the latch circuits 842*b*, and the state of the selection switch 841 becomes SEL3 by the select signal such that DATA1-3 is latched (held) in the latch circuits 842*c*.

Next, DATA1-4 is output as a fourth (Nth) driving signal from DACs 853 in a state in which the DATA1-1 is latched (held) in the latch circuits 842*a*, DATA1-2 is latched (held) in the latch circuits 842*b* and DATA1-3 is latched (held) in the latch circuits 842*c*, and the state of the selection switch 841 becomes SEL4 by the select signal such that DATA1-4 is latched (held) in the latch circuits 842*d*.

Thereafter, the output of the voltage from the DACs (voltage output units) 853 in a blank state, the latch switch 843 is turned on, DATA 1-1 to 1-4 held in the latch circuits 842*a* to 842*d* simultaneously are output to and held in the voltage holding capacitors 832 corresponding thereto.

The output voltages are held in the voltage holding capacitors 832, the enable switches 845 are turned on after the latch switch 843 is turned off, the constant current according to the voltages (DATA1-1 to 1-4) held in the voltage holding capacitors 832 flow in the light emitting devices 74 through the constant current transistors 831 such that the light emitting devices 74 of the light emitting device groups 71 emit light.

With respect to the output of DATA2-1 to 2-4 and thereafter, similar to the above-described output of DATA1-1 to 1-4, the selection switch 841, the latch switch 843 and the enable switches 845 repeatedly are operated. Accordingly, it is possible to form the spots SP in the pixels PX.

In this way, timings when the 1 to (N−1)th driving signals output from the driver ICs 85 are input to the light emitting devices 74 are delayed to timings when the Nth driving signal output from the driver ICs 85 are input to the light emitting devices 74 such that the light emitting devices 74 simultaneously can emit light in the different light emitting device groups 71. To this end, it is possible to prevent an error from occurring in the switching of the light emission of the plurality of light emitting devices 74 belonging to the different light emitting device groups 71 and, as a result, realize a high-accuracy exposure process. In particular, in the present embodiment, simultaneously by releasing the holding of the driving signals after sequentially holding the 1-Nth driving signals output from the driver ICs 85, it is possible to control the light emission timings of the light emitting devices 74 of the different light emitting device groups 71 with high accuracy. In addition, the Nth driving signals may be input to the light emitting devices 74 without being held. In this case, the latch circuits 842*d* corresponding to the light emitting devices 74 of the light emitting device groups 71 to which the Nth driving signals are input are omitted and the holding of the 1 to (N−1)th driving signals are released at the output timings of the Nth driving signals.

The driver ICs 85 are the output units for sequentially outputting the driving signals for driving the light emitting devices 74 belonging to the light emitting device groups 71 to the light emitting device groups 71. The driver ICs 85 allow the plurality of light emitting devices 74 belonging to the plurality of the light emitting device groups 71 to emit light using the driving signals sequentially output from one driver IC 85. Accordingly, it is possible to reduce the number of wires of the signals for controlling the lighting of the light emitting devices 74. As a result, it is possible to prevent or suppress noise from being mixed from the wires and realize a high-accuracy exposure process.

Each of the driver ICs 85 has the shift register 851, the latch circuit 852 and the DAC 853 (D/A converter).

In each of the driver ICs 85, a start pulse signal (start) is triggered from the control circuit 822 to the shift register 851 such that a data signal (DATA) synchronized with a clock signal (CLK) is sent. Meanwhile, a Latch signal (Latch) is sent from the control circuit 822 to the latch circuit 852, and the data signal is latched such that the data signal is aligned in the shift resister 851 at predetermined timing. The data signal (digital signal) is sent to the DAC 853 in a state of being aligned at the predetermined timing, and the DAC 853 outputs a predetermined voltage signal (analog signal) (according to image information) to the above-described latch circuits 842.

The above-described driving circuit 821 is an active type driving circuit, but a passive type driving circuit 821A may be used instead of the driving circuit 821.

The plurality of constant current driving circuits 83, the selection switch 841, the plurality of enable switches 845, the latch switch 843 and the latch circuits 842 are provided on the above-described support plate 72 so as to configure a first circuit unit. The first circuit unit configures a delay unit for delaying timing when the driving signals output from the driver ICs 85 (output units) are input to the light emitting devices 74. The driver ICs 85 are semiconductor devices configuring a portion of the driving circuit 821. The latch circuits 842 configure a holding unit (are included in a holding unit).

The above-described driving circuit 821 is controlled by the control circuit 822.

The control circuit 822 controls the Operation of the driving circuit 821. The control circuit 822 controls the operation of the driving circuit 821 based on the signal from the below-described printer controller 18. The control circuit 822 configures the second circuit unit.

The control circuit 822 includes an interface circuit 86, a plurality (two in the present embodiment) of data control circuits 87 and a correction value memory 88.

The interface circuit 86 receives a signal from the printer controller 18 included in the main body (the outside of the line head 13) of the image forming apparatus 1. In the present embodiment, as shown in FIG. 6, the interface circuit 86 includes a reception circuit using Low Voltage Differential Signaling (LVDS), receives data expanded on data lines together with a timing clock from the printer controller 18, and distributes the data to the data control circuits 87.

The data control circuit 87 corrects the data from the interface circuit 86 based on correction data of the correction value memory 88 such that the light emission amount of the light emitting devices 74 is optimized, and sends the corrected data to the above-described driver ICs 85 (shift register 851) together with the control signal. In addition, the data control circuit 87 outputs a signal for switching the above-described latch switch 843 and selection switch 841.

The printer controller 18 has a function for transmitting the signal for controlling the driving of the light emitting devices 74 to the control circuit 822. In the present embodiment, the printer controller 18 includes a head controller 181 for controlling the driving of the line head 13, and a transmission circuit 182 for transmitting the signal from the head controller 181 to the above-described interface circuit 86. The printer controller 18 has a function for controlling the units of the image forming apparatus 1.

The driving of the light emitting devices 74 are controlled by the control system (circuit unit 82). The configuration of the above-described control system is only exemplary and is not limited thereto.

According to the above-described line head 13, since the light emitting devices 74 of the different light emitting device groups 71 simultaneously can emit light, it is possible to prevent an error from occurring in the switching of the light emission of the plurality of light emitting devices 74 of the different light emitting device groups 71 and, as a result, realize a high-accuracy exposure process. In particular, in the line head 13, since the plurality of light emitting devices 74 belonging to the plurality of light emitting device groups 71 can emit light using the driving signals sequentially output from one output unit (DAC 853 of the driver IC 85), it is possible to reduce the number of wires of the signals for controlling the lighting of the light emitting devices 74. As a result, it is possible to prevent or suppress noise from being mixed from the wires and realize a high-accuracy exposure process.

According to the image forming apparatus 1, it is possible to obtain a high-quality image by realizing the high-accuracy exposure process.

That is, by sequentially outputting the driving signals for allowing the plurality of light emitting devices 74 belonging to the N (N is an integer of 2 or more) light emitting device groups 71 to the light emitting device groups 71, delaying the input timings of the 1 to (N−1)th driving signals output to the input timings of the Nth driving signals output, and allowing the light emitting devices 74 of the different light emitting device groups 71 simultaneously to emit light, and forming a latent image on the photosensitive drum 11 (using the image processing method of the invention), it is possible to realize a high-accuracy exposure process and obtain a high-quality image.

Although the line head and the image forming apparatus of the invention are described with respect to the shown embodiment, the invention is not limited thereto, and the units configuring the line head and the image forming apparatus may be replaced with certain units having the same functions. In addition, a certain configuration may be added.

The lens array is not limited to a lens array in which the plurality of lenses is disposed in a 2×n matrix, and, for example, the lenses may be disposed in a 3×n matrix or a 4×n matrix.

In addition, one imaging optical system may include a plurality of lenses or include one or three or more lens surfaces.

In addition, a lens array having a structure in which a plurality of lens arrays including a plurality of refractive-index distribution type rod lenses is disposed zigzag in the main scanning direction may be used as the lens array.

Although the light emitting devices are arranged in a 1×n matrix, for convenience of description, in the above-described embodiment, the invention is not limited thereto, and the light emitting devices may be arranged in a 2×n matrix or a 3×n matrix.

The entire disclosure of Japanese Patent Applications No. 2008-304982, filed on Nov. 28, 2008 is expressly incorporated by reference herein.

What is claimed is:

1. A line head comprising:

a light emitting device array in which N (N is an integer of 2 or more) light emitting device groups including a plurality of light emitting devices are arranged;

an output unit which sequentially outputs driving signals for driving the light emitting devices of the light emitting device groups to the light emitting device groups; and a delay unit which delays input timings when the driving signals output from the output unit are input to the light emitting devices, wherein the delay unit delays the input timings of the 1 to (N−1)th driving signals output from the output unit to the input timings of the Nth driving signals output from the output unit, and allows the light emitting devices of the different light emitting device groups simultaneously to emit light, and the delay unit includes a holding portion, and sequentially holds the 1 to Nth driving signals output from the output unit in the holding portion and simultaneously then releases the holding of the 1 to Nth driving signals held in the holding portion.

2. The line head according to claim 1, wherein the holding portion has latch circuits provided in correspondence with the light emitting device groups, and the delay unit has a latch switch for simultaneously switching ON/OFF of the latch circuits.

3. An image forming method comprising:

sequentially outputting driving signals for driving light emitting devices of N (N is an integer of 2 or more) light emitting device groups to the light emitting device groups; and delaying the input timings of the 1 to (N−1)th output driving signals to the input timings of the Nth output driving signals, and allowing the light emitting devices of the different light emitting device groups simultaneously to emit light so as to form a latent image on a latent image carrier, wherein:

image optical systems are provided in correspondence with the light emitting device groups, for imaging light from the light emitting devices, the light emitting device groups are arranged in a first direction and are arranged in a second direction perpendicular to or substantially perpendicular to the first direction, and when the light emitting devices of the light emitting device groups simultaneously emit light, a gap between spot groups formed by imaging the light from the light emitting device groups by the imaging optical systems in the second direction is an integral multiple of a gap between pixels of the latent image in the second direction.

4. The image forming method according to claim 3, wherein, when the light emitting devices of the light emitting device groups simultaneously emit light, a gap between spots formed by imaging the light from the light emitting devices by the imaging optical systems in the second direction is an integral multiple of a gap between pixels of the latent image in the second direction.

5. The image forming method according to claim 3, wherein the imaging optical systems are arranged in the first direction and are arranged in the second direction, and a gap between the imaging optical systems in the second direction is an integral multiple of the gap between the pixels of the latent image in the second direction.

* * * * *